US007419246B2

(12) United States Patent
Malpica

(10) Patent No.: US 7,419,246 B2
(45) Date of Patent: Sep. 2, 2008

(54) FLEXIBLE CIRCUITS, FLEXIBLE CIRCUIT ASSEMBLIES AND ASSEMBLIES FOR USE WITH FLUID EJECTION APPARATUSES

(75) Inventor: William S. Malpica, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 336 days.

(21) Appl. No.: 11/365,005

(22) Filed: Mar. 1, 2006

(65) Prior Publication Data

US 2007/0206062 A1 Sep. 6, 2007

(51) Int. Cl.
*B41J 2/14* (2006.01)
*B41J 2/16* (2006.01)

(52) U.S. Cl. ..... 347/50; 347/58

(58) Field of Classification Search ..... 347/50, 347/56–59, 84–87
See application file for complete search history.

(56) References Cited

U.S. PATENT DOCUMENTS 5,424,767 A * 6/1995 Alavizadeh et al. ..... 347/17
5,815,050 A 9/1998 Brooks et al. ..... 333/161
5,885,855 A 3/1999 Liang ..... 438/128
5,952,726 A 9/1999 Liang ..... 257/778
6,133,891 A 10/2000 Josypenko ..... 343/895
6,174,046 B1 1/2001 Reid et al. ..... 347/50
6,290,333 B1 9/2001 Wade et al. ..... 347/50
6,604,814 B2 8/2003 Browning et al. ..... 347/50
6,652,072 B2 11/2003 Browning et al. ..... 347/50
2004/0207675 A1 10/2004 Otsuki ..... 347/19
2004/0215406 A1 10/2004 Hoen et al. ..... 702/50
2005/0231551 A1 10/2005 Gibson et al. ..... 347/45
2005/0264616 A1 12/2005 Silverbrook ..... 347/62

* cited by examiner

*Primary Examiner*—Juanita D Stephens
(74) *Attorney, Agent, or Firm*—Miller & Bernard, PLLC

(57) ABSTRACT

Assemblies for use with a fluid ejection apparatus, flexible circuit assemblies and flexible circuits. One such flexible circuit includes a flexible substrate and conductive lines adjacent the substrate. The conductive lines are capable of being operably connected with bonds of an ejector. Each of the lines has a resistance. At least one of the lines includes a length extension. A line having a length extension has substantially the same resistance as another one of the lines.

20 Claims, 7 Drawing Sheets

FLEXIBLE CIRCUITS, FLEXIBLE CIRCUIT ASSEMBLIES AND ASSEMBLIES FOR USE WITH FLUID EJECTION APPARATUSES

BACKGROUND OF THE INVENTION

1. Field of the Invention

The present invention relates generally to flexible circuits, and specifically, in an exemplary embodiment, to a flexible circuit having conductive lines, at least one of which having a length extension.

2. Background of the Invention

As an example of one use of a fluid ejection apparatus, the art of printing images with inkjet technology is relatively well known. In general, an image is produced by emitting ink drops from an inkjet cartridge assembly at precise moments such that they impact a print medium at a desired location. In one implementation, the inkjet cartridge assembly is supported by a movable print carriage within a device, such as an inkjet printer, and is caused to reciprocate/scan relative to an advancing print medium and emit ink drops at such times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, and the like. Moreover, technologies pertaining to inkjet have been extended into such diverse fields as printed electronics and micro-fluid medical devices, among other examples of technologies that utilize fluid ejection apparatuses.

Conventionally, an inkjet cartridge assembly includes a housing, a flexible circuit, such as a tape automated bonding (TAB) circuit and a printhead chip (sometimes generically referred to as a printhead). The TAB circuit and the printhead are often attached to the housing. The printhead generally includes ink jetting orifices in operable communication with actuator elements and ink, wherein ink droplets are ejected through the orifices onto the print medium in a known manner. The TAB circuit generally includes a flexible tape-like substrate which supports a plurality of conductive traces. The traces are connected at one end thereof with bond pads of the printhead and at an opposite end thereof with contact pads. By way of example and referring briefly to FIG. 6, a conventional connection/termination between the conductive traces 30 and the contact pads 32 is shown. As shown, a portion of a conventional trace 30 leading to a contact pad 32 is typically relatively straight line and leaves empty/free circuit space surrounding the contact pad 32. The contact pads 32 are often used to engage corresponding electrical terminals on, for example, a movable carriage assembly, such as when an inkjet cartridge is snapped into place, and are used to allow, among other things, actuator elements of the printhead to be actuated to eject the droplets of ink onto the print medium during use. The conductive traces on the TAB circuit are typically in the form of copper traces which are formed via an etching process on a bottom side of the flexible tape adjacent the housing.

A shortcoming associated with conventional TAB circuits is that, in order to produce a high print quality, a balanced electrical current should be passed from the contact pads through the conductive traces and to the bond pads of the printhead (a balanced electrical current should also be passed from the bond pads to any actuated actuator elements as well, but that technology is not part of the present invention). Any imbalance in such a current can result in an imbalance in how the ink is ejected by the inkjet cartridge assembly. This, in turn, may lead to poor image quality.

Conventionally, it might be desired to make the resistance of the conductive traces, specifically the PWR and ground (GRN) traces, of the TAB circuit relatively the same. The conductive traces that extend between the contact pads and the printhead are typically of varying lengths. Therefore, in an attempt to maintain a resistive balance, the conductive traces are typically drawn with widths inversely proportional to their lengths. Typically, the longer traces are wider and the shorter traces are narrower, following that:

$$R=\rho L/(w*h)$$

where: R=resistance; ρ=resistivity; L=length; w=width; and h=height.

Unfortunately, there is a limit as to how narrow the shortest traces can be drawn. For example, the dielectric in conventional TAB circuits can only withstand a certain temperature rise caused by the current density passing through the associated conductive traces. Since current density is the current divided by the cross-sectional area of the trace, the width of the traces must be wide enough to accommodate the temperature rise. Known TAB circuits and methods thereof have attempted to draw the longer conductive traces wider, where possible, to compensate for the foregoing disadvantage. Often, due to the physical constraints of some TAB circuits, the longer traces cannot be drawn wide enough to match the resistance of the shortest traces. Therefore, an imbalance in the resistance of the traces might remain. This, in turn, can lead to an imbalance in actuator actuation energy, for example, and may decrease the overall print quality.

In view of the disadvantages of the current methods and apparatus, amongst other reasons, a need still exists for a method and apparatus for providing, for example, a TAB circuit which is constructed such that the conductive traces maintain a resistive balance.

SUMMARY OF THE INVENTION

In an exemplary embodiment, the present invention comprises an assembly, such as an inkjet cartridge assembly, for use with a fluid ejection apparatus, such as a printer. One such assembly includes at least one fluid chamber and an ejector having bond pads. The ejector is in fluid communication with the at least one fluid chamber. The assembly also includes a flexible circuit. The flexible circuit includes a flexible substrate and has conductive lines in connection with contact pads. The conductive lines are also in connection with the bond pads of the ejector. Each of the lines has a resistance. At least one of the lines includes a length extension. A line having a length extension has substantially the same resistance as another one of the lines.

In accordance with another exemplary embodiment of the present invention, a flexible circuit assembly is provided. One such flexible circuit assembly includes an ejector having bond pads and a flexible circuit. The flexible circuit includes a flexible substrate and has conductive lines in connection with contact pads. The conductive lines are also in connection with the bond pads of the ejector. Each of the lines has a resistance. At least one of the lines includes a length extension. A line having a length extension has substantially the same resistance as another one of the lines.

Still another exemplary embodiment of the present invention involves a flexible circuit. One such flexible circuit includes a flexible substrate and conductive lines adjacent the substrate. The conductive lines are capable of being operably connected with bonds of an ejector. Each of the lines has a resistance. At least one of the lines includes a length extension. A line having a length extension has substantially the same resistance as another one of the lines.

Additional features and advantages of the invention are set forth in the detailed description which follows and will be readily apparent to those skilled in the art from that description, or will be readily recognized by practicing the invention as described in the detailed description, including the claims, and the appended drawings. It is also to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof. Additionally, the drawings and descriptions are meant to be merely illustrative and not limiting the intended scope of the claims in any manner.

DETAILED DESCRIPTION OF THE EXEMPLARY EMBODIMENTS

Figure 1:
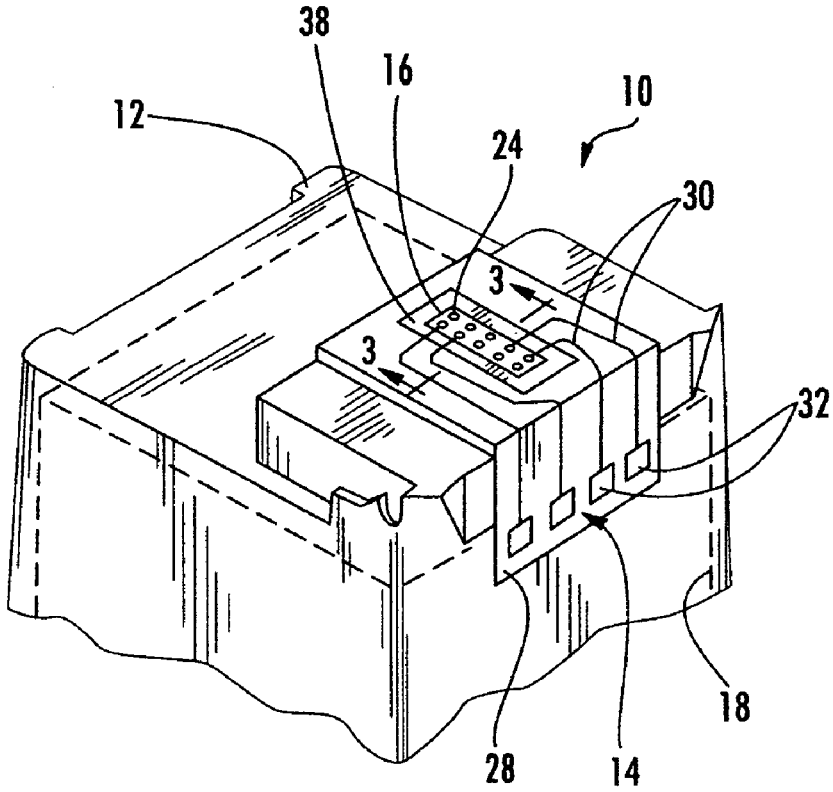
FIG. 1 is a simplified perspective view of an exemplary embodiment of an inkjet cartridge assembly in accordance with the present invention.

Reference will now be made in detail to exemplary embodiments of the invention, which are illustrated in the accompanying drawings. Whenever possible, the same reference numerals will be used throughout the drawings to refer to the same or like parts. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Referring now to the drawings, and more particularly to FIGS. 1-5, an assembly for use with a fluid ejection apparatus and constructed in accordance with one exemplary embodiment of the present invention is illustrated generally as inkjet cartridge assembly 10. Although other assemblies are contemplated by the present invention, inkjet cartridge assembly 10 is described to illustrate certain aspects of the present invention. The inkjet cartridge assembly 10 generally includes a housing 12, a flexible circuit such as TAB circuit 14 and an ejector, such as printhead 16. It will be understood by those skilled in the art that the shape and size of the housing 12, flexible circuit, and/or printhead 16 can vary and often depends upon the desired application of cartridge assembly 10.

At least one fluid chamber 18 operable for holding, for example, an initial or refillable supply of ink, is in fluid communication with printhead 16. Although the chamber 18 may be remote from (e.g., connected by tubing) and/or in selectively removable relationship with housing 12 (e.g., where the chamber is a tank), the illustrated embodiment includes a fluid chamber disposed (integrally or selectively removable) within the housing 12. In the embodiment shown, housing 12 includes a single inner chamber 18 which is disposed in fluid communication with a single printhead 16; however, housing 12 may include multiple inner chambers which respectively contain, for example, inks with different colors, hues or saturation densities, or other fluids. If housing 12 includes multiple inner chambers, cartridge assembly 10 may be provided with, for example, a single or multiple printheads, with each such printhead being in fluid communication with one or more of the multiple inner chambers. Also, the housing 12 of cartridge assembly 10 is shown in an inverted position in FIG. 1 for ease of illustration, but normally is positioned such that printhead 16 faces in a downward direction during use (e.g., where gravitational forces cause the ink within inner chamber 18 to flow to printhead 16).

Printhead 16 may be attached to housing 12. More particularly, referring to FIGS. 2-3, housing 12 might include a recess area, such as die cavity 20, having a shape which generally corresponds to the shape of printhead 16 and dimensions which are at least slightly larger than those of printhead 16. A die adhesive 22 may be used to adhesively bond printhead 16 within cavity 20 and to housing 12. Die adhesive 22 may be of any conventional composition.

Printhead 16 generally includes jetting orifices 24 which are in fluid communication with chamber 18 via appropriate feed channels, vias, etc. (not shown) in known manner. A plurality of actuator elements, such as thin-film resistors, piezoelectric elements, or MEMs devices, for example, (not shown) are disposed within/on printhead 16 in corresponding relationship with orifices 24. Oftentimes, the orifices 24 will be at least partially provided in a nozzle plate that is adhered to an actuator chip that includes the actuator elements. In operation, a thin-film resistor element, for example, can be used to cause the rapid formation of a bubble adjacent a corresponding orifice 24 to eject an ink drop toward a print medium (not shown).

As illustrated, TAB circuit 14 generally includes a flexible substrate 28. Flexible substrate 28 may be comprised of electrically insulating material, such as a polyimide material; however, other suitable materials may be used. TAB circuit 14 may also have contact pads 32, such as those used for electrically driving elements (e.g., actuator elements and/or any of their attendant driving and logic circuitry/devices) in response to signals from a controller of, for example, a fluid ejection apparatus, such as a printer, fax machine, copier, photo-printer, plotter, all-in-one, medical device, etc., in communication therewith.

When bonded to a printhead 16, conductive lines, such as traces 30, of the TAB circuit 14 electrically connect the contact pads 32 to elements of the printhead 16, such as through bond pads on the printhead. The conductive traces 30 and contact pads 32 may be constructed of, for example, copper or an alloy (e.g., beryllium copper) formed adjacent (e.g., on) a surface of flexible substrate 28 using, for example, conventional plating and photolithographic etching processes. As is conventional, a protective coating 82 may be applied over traces 30 and contact pads 32.

To expose contact pads 32 on an opposing surface of flexible substrate 28, openings can be formed through flexible substrate 28 using conventional techniques. The exposed contact pads may be plated in, for example, gold 80. The traces 30 lead from the contact pads 32 to an opening 38 (sometimes referred to as a "window"), such that they may be bonded to printhead 16 (e.g., via bond pads on an actuator chip of the printhead). Those skilled in the art know various techniques for facilitating such connections, such as single-point thermosonic bonding, thermocompression bonding, and wire bonding. For simplicity, FIG. 1 only shows four (4) contact pads 32 and four (4) traces 30, but present day printheads may have much larger or smaller quantities of the same and any number is equally embraced herein. Further, those skilled in the art should appreciate that while such number of contact pads and traces equal one another, actual printheads may have unequal numbers.

Figure 2:
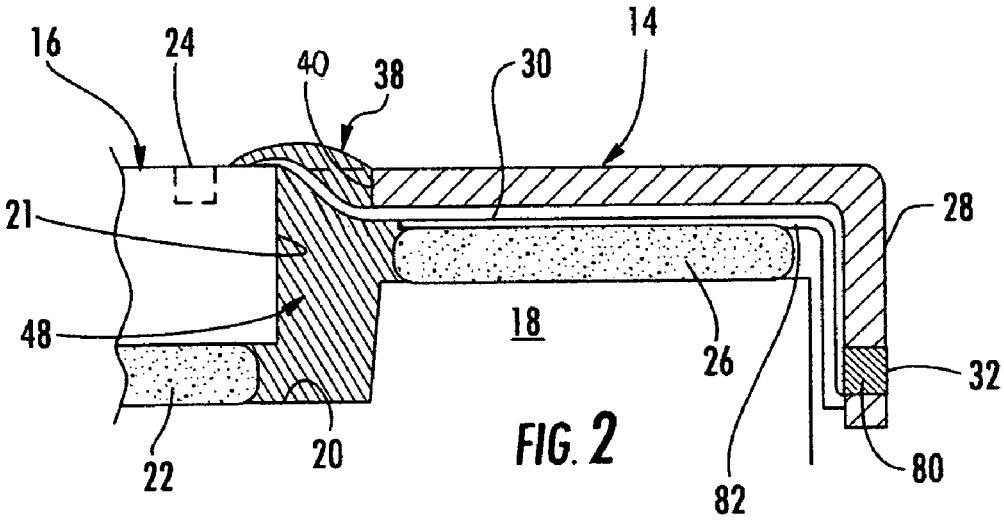
FIG. 2 is an enlarged, sectional view of the inkjet cartridge assembly shown in FIG. 1.
Figure 3:
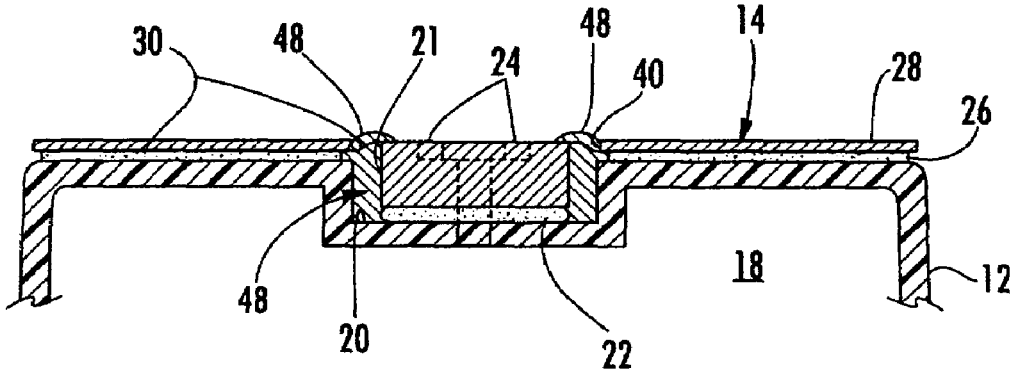
FIG. 3 is a sectional view taken along line 3-3 in FIG. 1.

As shown, TAB circuit 14 may be adhered to housing 12 using a preform adhesive 26. For example, TAB circuit 14 with preform adhesive 26 thereon may be pressed against housing 12 to adhesively bond TAB circuit 14 with housing 12. In some embodiments, die attach adhesive (alone or in addition to perform 26) may also be used to adhere TAB circuit 14 to housing 12. As shown in FIGS. 1-2, TAB circuit 14 may be adhered to, for example, two or more surfaces of housing 12. In the illustrated embodiment, the two surfaces are perpendicularly arranged to one another about an edge of the housing 12.

Figures 4, 4A:
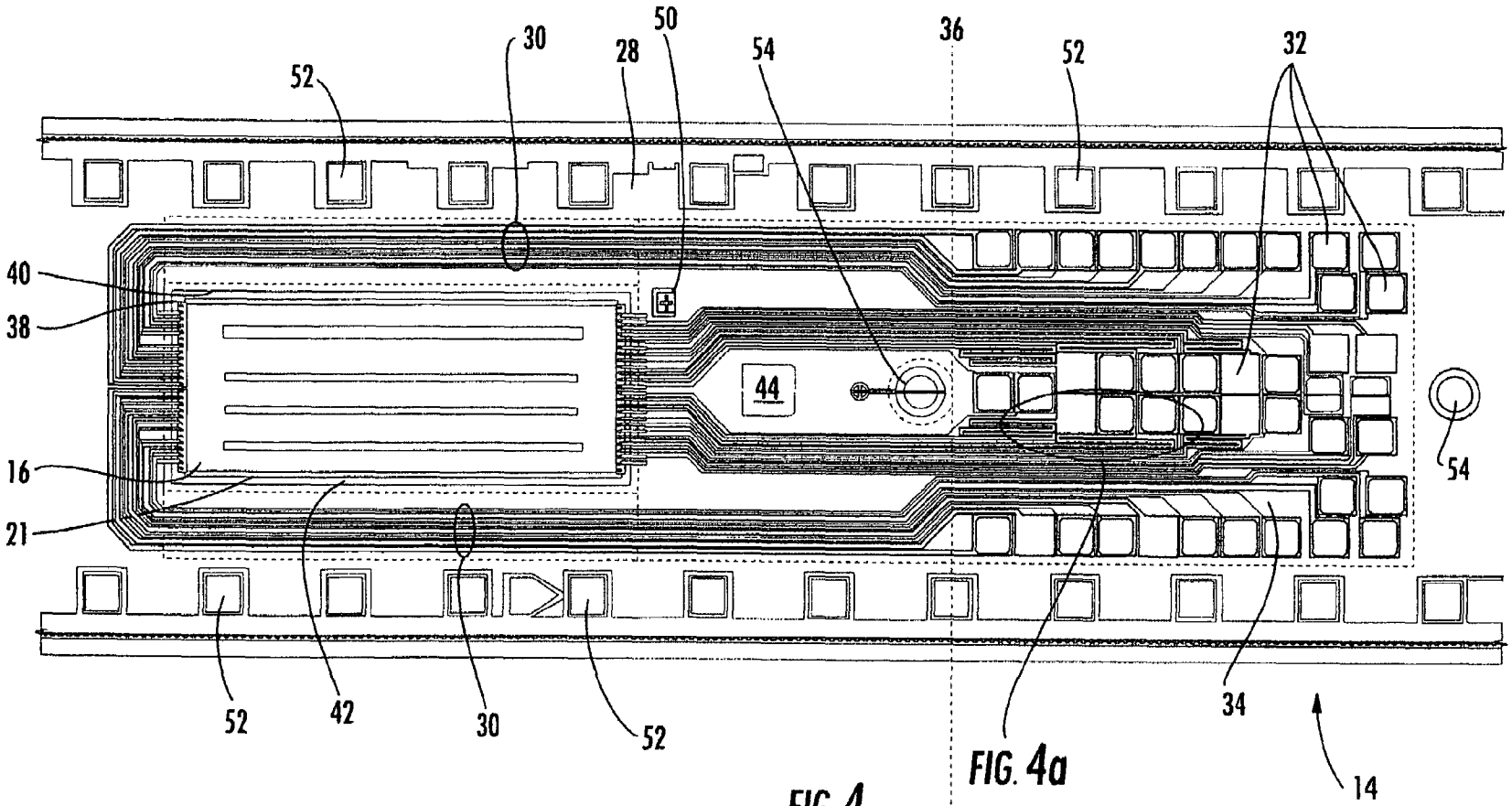
FIG. 4 is a plan view of a tape automated bonding circuit, as designed and constructed according to an exemplary embodiment of the present invention.
FIG. 4*a* is an enlarged view of a portion of the tape automated bonding circuit of FIG. 4, which shows serpentine-like traces terminating at certain contact pads.
Figure 4A:
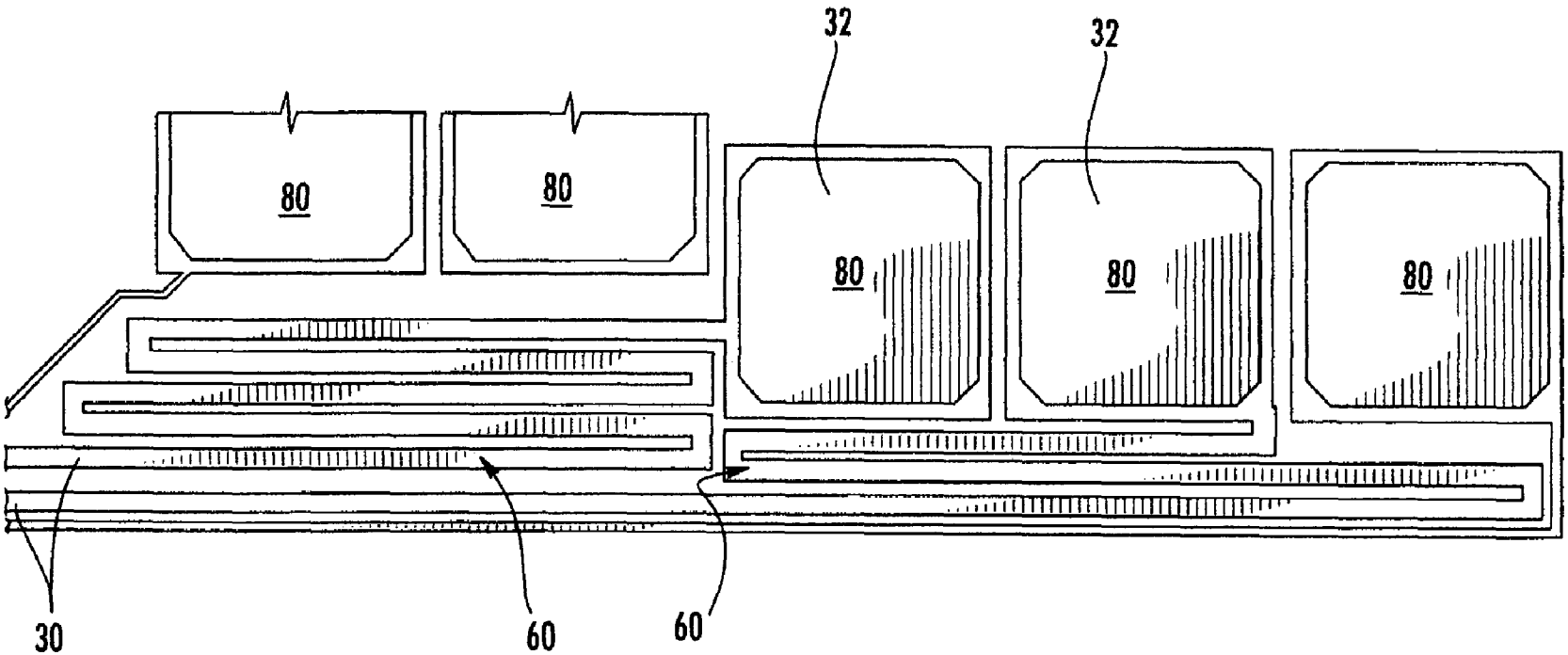

Referring now specifically to FIG. 4, a TAB circuit 14 constructed in accordance with an exemplary embodiment of the present invention is illustrated. As illustrated, a backside surface (i.e., the surface adhered to the assembly 10) of the flexible substrate 28 is shown such that the various traces 30 connected to the contact pads 32 and bond pads of the printhead 16 can be seen (wherein printhead 16 is depicted irrespective of the existence of a nozzle plate). Extending along the outer edges of the TAB circuit 14 are square openings/windows (also referred to as sprocket holes) 52, which may be used to advance the flexible substrate 28 of TAB circuit 14 during a manufacturing process. Typically, the flexible substrate 28 is provided on a reel so that it may be used in a step and repeat process for bonding the conductive traces 30 to the bond pads of printhead 16. In an exemplary embodiment, the edge portion(s) of the flexible substrate 28 containing the windows 52 are eventually removed. It will be appreciated by those skilled in the art that, in many ways, such a TAB circuit 14 has the appearance of photographic film, which also uses such square openings/windows that mate with a drive sprocket to advance film through a camera.

As previously mentioned, the flexible substrate 28 of TAB circuit 14 may also include a window 38 disposed therein, such as one that has a shape that may generally correspond to that of printhead 16. For example, window 38 may be defined by an interior peripheral edge 40 of flexible substrate 28, wherein window 38 has dimensions that are larger than those of an exterior peripheral edge 21 of printhead 16. The area between peripheral edge 40 of window 38 and edge 21 of printhead 16 define a free trace area 42 through which traces 30 extend to bond pads. The traces 30 depicted in FIG. 4 are shown in two halves, with each half running generally longitudinally from the contact pads 32 to window 38. As shown, the traces 30 are relatively small in size, and are both narrow and closely spaced in the areas illustrated. Finally, a number of openings 54 may be provided in flexible substrate 28 to facilitate handling and alignment by tooling.

In the exemplary embodiment shown, the contact pads 32 are grouped together near one end of the flexible substrate 28 in an area that can be referred to as a contact pad area 34 (indicated conceptually to the right of dashed line 36 in FIG. 4). A portion of a trace 30 which is carried by flexible substrate 28 within contact pad area 34 will be referred to hereinafter as a contact pad area portion of that trace. In use, the exemplary contact pads 32 might mechanically engage corresponding electrical terminals (not shown) on, for example, a movable carriage assembly within an inkjet printer (such as when cartridge assembly 10 is snapped into place on a carriage assembly for use). Accordingly, the exemplary contact pads 32 are made relatively large so as to make easy targets, but contact pads of other sizes and shapes are contemplated under the present invention. Moreover, TAB circuit 14 may include any suitable number of contact pads 32, and likely includes a greater number than shown. In any event, it should be noted that the drawing artwork of FIG. 4 represents a magnified version of a TAB circuit 14. An actual TAB circuit, at least one used with inkjet cartridge assemblies, is typically much smaller than depicted in this illustration.

As previously stated, in an exemplary embodiment, each trace 30 typically extends between a corresponding contact pad 32 and into window 38. Traces 30 may be assigned various functions as part of the operation of printhead 16. For example, an individual trace 30 may be assigned with a power (PWR), address or ground (GRN) function. However, traces 30 may also have functions that are not directly related to ejecting ink. For example, one or more of the traces 30 may be used to transmit or receive information to/from memory (or any other component, device or circuit, for example) associated with printhead 16. The actual selection and function of the conductive traces 30 for a particular embodiment is of known design, and may vary considerably from manufacturer to manufacturer; thus, the same is not described further herein.

The portion of flexible substrate 28 which carries traces 30 between contact pad area 34 and window 38 is defined as a substrate held area, indicated conceptually by reference number 44 to the left of dashed line 36 in FIG. 4. A portion of a trace 30 which is carried by flexible substrate 28 within substrate held area 44 will be referred to hereinafter as a substrate held portion of that trace. Similarly, a portion of a trace 30 which extends into free trace area 42 shall be referred to hereinafter as a free trace portion of that trace. Meanwhile, a portion of a trace 30 which extends over printhead 16 outside of free trace area 42 shall be referred to hereinafter as a printhead held portion of that trace. The free trace portion and printhead held portion of a trace 30 can thus terminate/begin immediately adjacent to and in line with an edge 21 of printhead 16.

Unlike conventional TAB circuit designs, according to an exemplary embodiment of the present invention, one or more of the traces 30 (e.g., the traces having otherwise relatively shorter lengths) may be lengthened with a length extension(s) to provide, for example, resistive balancing between the traces. For example, a contact pad area portion of one of the traces 30 may include a length extension, such as one proximate to one of contact pads 32 (e.g., in an area substantially near the connection/termination point of a corresponding contact pad 32 and trace 30). The length of trace 30 added by the length extension may be used to increase the resistance of that trace, such as in an effort to maintain a resistive balance between the traces 30. By contrast, conventional approaches may have required that the otherwise longer traces be formed as wider traces in an attempt to achieve substantial resistive balancing.

As contemplated by the present invention, a length extension may be provided by, for example, forming a length of one of the traces 30 in a geometric pattern, for example. In an exemplary embodiment, the length extension may be located in a space of the contact pad area 34 which would otherwise be empty. In the exemplary embodiment shown in FIGS. 4 and 4*a*, certain ones of the traces 30, which in this embodiment are traces connected to certain PWR and GRN contact pads 32, include length extensions 60, which comprise portions of the traces formed in a substantially serpentine-like pattern. Accordingly, by using the length extensions 60 of traces 30, a balanced current may be passed to the printhead 16 from contact pads 32, thereby helping produce a high quality printed image, for example.

Turning now to other features of the illustrated TAB circuit 14, a registration mark 50 comprised of a relatively large plus sign ("+") is provided on the flexible substrate 28 near a corner of the window 38 so as to aid in registration when mating the TAB circuit 14 to printhead 16.

In addition, as previously discussed, a coating 82 may be placed on the backside of the TAB circuit 14. In an exemplary embodiment, such a coating 82 may be silk screened onto selected areas of the TAB circuit 14. That is, certain areas of the backside of the TAB circuit 14 are conventionally masked off, and the coating 82 is applied to the non-masked areas. In an exemplary embodiment, the tolerance of such coatings is typically between 300-500 μm. Typically, once the printhead 16 and TAB circuit 14 are bonded, and adhered to housing 12, an encapsulant 48 (or other protective material) may also be applied over, for example, the free trace portions and printhead held portions of traces 30, such as to inhibit the exposure of traces 30 to ink and/or other environmental effects.

Figures 5, 5A:
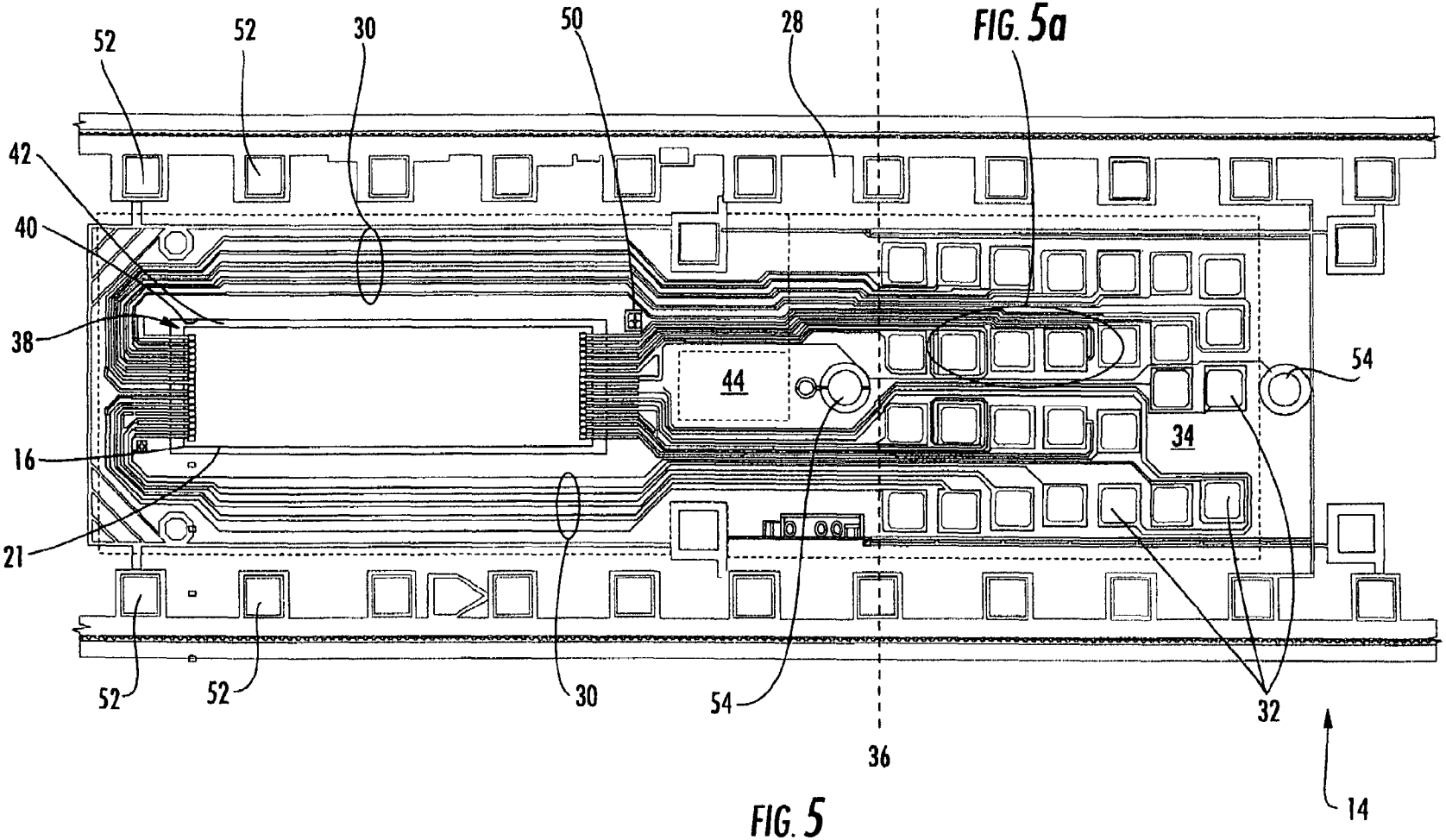
FIG. 5 is a plan view of a tape automated bonding circuit, as designed and constructed according to another exemplary embodiment of the present invention.
FIG. 5*a* is an enlarged view of a portion of the tape automated bonding circuit of FIG. 5, which shows spiral-like traces wrapping at least partially around and terminating at certain contact pads.
Figure 5A:
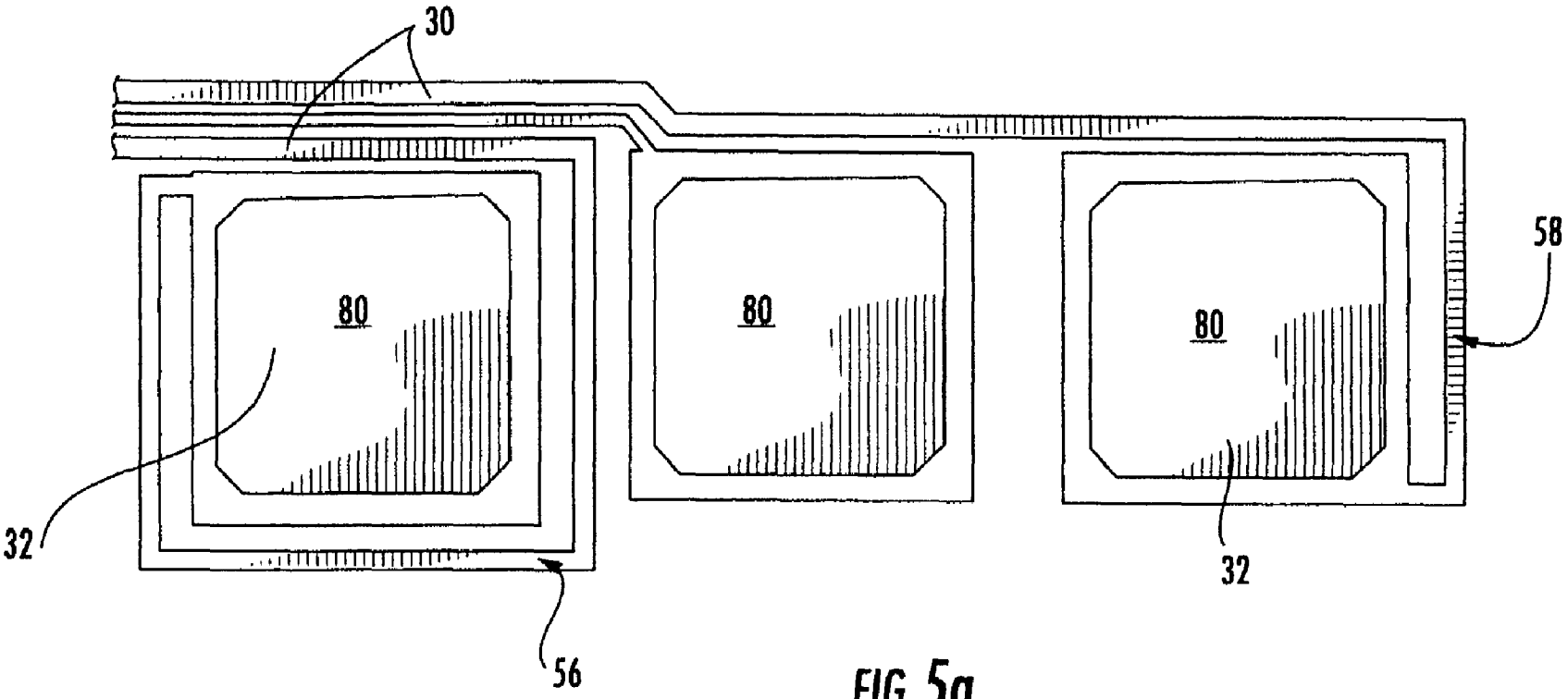
Figure 6:
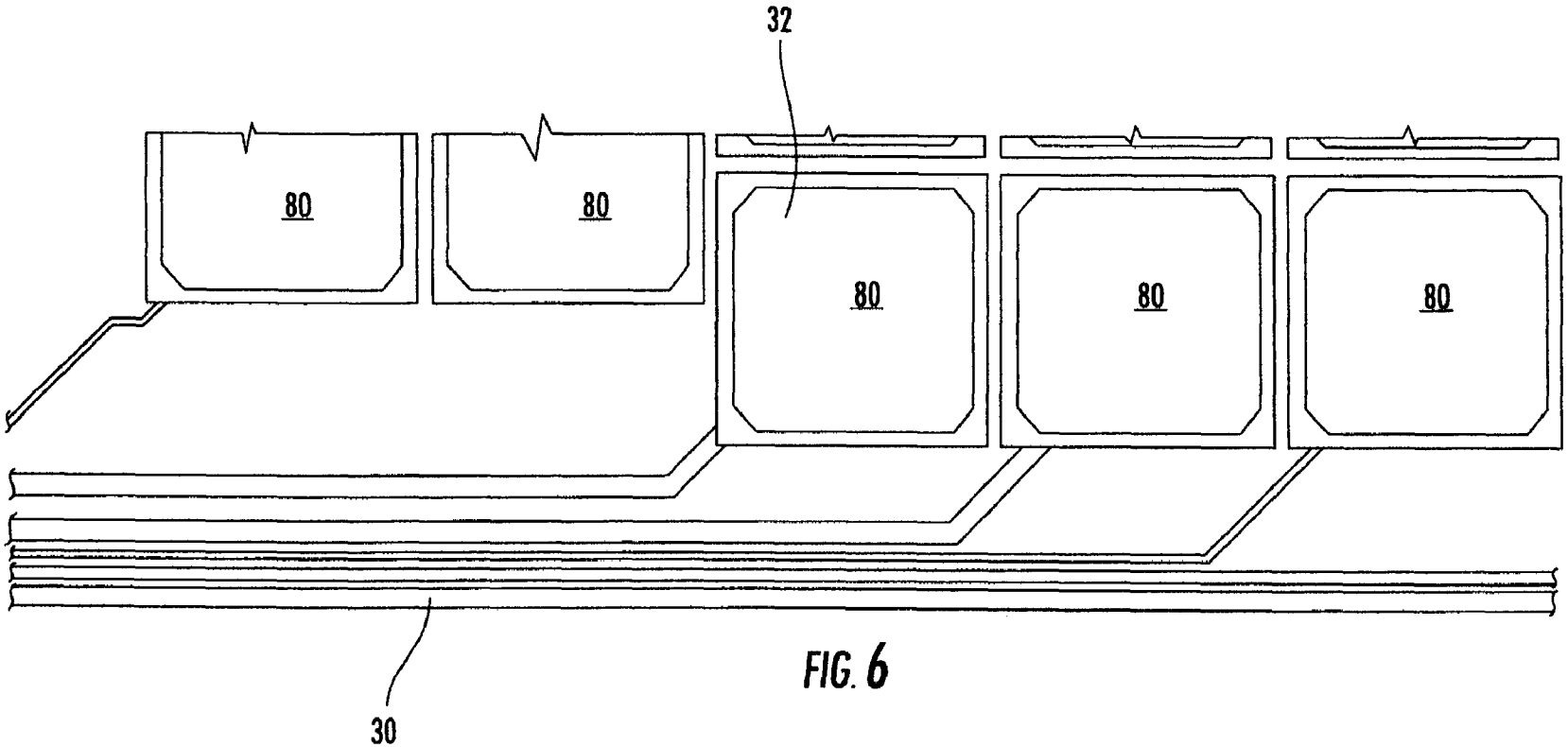
FIG. 6 is an enlarged view of a portion of a tape automated bonding circuit constructed in accordance with the prior art.

Referring now to FIG. 5, a TAB circuit 14 constructed in accordance with another exemplary embodiment of the present invention is illustrated. In this illustrated embodiment, as more easily seen in FIG. 5A, portions of traces 30 are formed in spiral-like patterns (e.g., traversing at least partially around one of the contact pads) to create length extensions 56 (which substantially wraps around a respective contact pad 32 to which the trace is connected) and 58. As can be understood, other embodiments of length extensions can be used in accordance with the present invention, and the present invention should not be limited to the disclosed spiral-like and serpentine-like embodiments.

It will be understood that the shape and dimensions of the disclosed TAB circuits, or any other flexible circuit, can be significantly modified without departing from the principles of the present invention. Certainly the number, shape, and directions of the lines could be modified, especially for embodiments destined for use with inkjet cartridges, which may use different numbers of actuators, and therefore require different numbers of electrical signals. This variation is not only between manufacturer to manufacturer, but also between different inkjet printer models produced by a single manufacturer.

It will also be understood that the materials used in today's TAB circuits, as disclosed above, could significantly change over time, without departing from the principles of the present invention. Certainly improvements in insulative and conductive compounds are envisioned by the inventors. Accordingly, it will be apparent to those skilled in the art that various modifications and variations can be made to the present invention without departing from the spirit and scope of the invention. Thus, it is intended that the present invention cover all modifications and variations of this invention, provided those alternative embodiments come within the scope of the appended claims and their equivalents.

What is claimed is:

1. An assembly for use with a fluid ejection apparatus, comprising:

at least one fluid chamber;

an ejector having bond pads and being in fluid communication with the at least one fluid chamber; and a flexible circuit comprising a flexible substrate and having conductive lines in connection with contact pads, the conductive lines also being in connection with the bond pads of the ejector, each of the lines having a resistance, wherein at least one of the lines includes a length extension and wherein a line having a length extension has substantially the same resistance as another one of the lines.

2. The assembly of claim 1, wherein the length extension comprises a substantially serpentine-like portion of the respective line.

3. The assembly of claim 1, wherein the length extension comprises a substantially spiral-like portion of the respective line.

4. The assembly of claim 3, wherein the substantially spiral-like portion of the respective line traverses at least partially around one of the contact pads.

5. The assembly of claim 4, wherein the one of the contact pads that the substantially spiral-like portion of the respective line traverses at least partially around is connected to the respective line.

6. The assembly of claim 1, wherein more than one of the lines has a length extension, wherein each of the lines has substantially the same resistance.

7. The assembly of claim 1, wherein the ejector and the flexible circuit are adhered to a housing.

8. The assembly of claim 7, wherein the at least one fluid chamber is disposed within the housing.

9. The assembly of claim 7, wherein the at least one fluid chamber is remote from the housing.

10. The assembly of claim 7, wherein the at least one fluid chamber is in a selectively removable relationship with the housing.

11. The assembly of claim 1, wherein the lines comprise traces.

12. The assembly of claim 11, further comprising a protective material applied to at least a free trace portion of the traces.

13. The assembly of claim 1, wherein the ejector comprises a printhead chip.

14. The assembly of claim 13, wherein the printhead chip comprises an actuator chip and a nozzle plate.

15. The assembly of claim 1, wherein the length extension is proximate to one of the contact pads.

16. The assembly of claim 15, wherein the one of the contact pads that is proximate to the length extension is connected to the line having the length extension.

17. The assembly of claim 1, wherein the conductive lines are bonded to the bond pads of the ejector by one of single-point thermosonic bonding, thermocompression bonding, and wire bonding.

18. The assembly of claim 1, wherein the flexible circuit comprises a tape automated bonding (TAB) circuit.

19. A flexible circuit assembly comprising:

an ejector having bond pads;

a flexible circuit comprising a flexible substrate and having conductive lines in connection with contact pads, the conductive lines also being in connection with the bond pads of the ejector, each of the lines having a resistance, wherein at least one of the lines includes a length extension and wherein a line having a length extension has substantially the same resistance as another one of the lines.

20. A flexible circuit comprising:

a flexible substrate;

conductive lines adjacent the substrate and being capable of operably connecting with bond pads of an ejector, each of the lines having a resistance; and contact pads in connection with the conductive lines, wherein at least one of the lines includes a length extension and wherein a line having a length extension has substantially the same resistance as another one of the lines.

* * * * *